US005896797A

United States Patent [19]

Thompson

[11] Patent Number: 5,896,797

[45] Date of Patent: Apr. 27, 1999

[54] SYSTEM AND METHOD FOR COLLATING AND STACKING TWO STREAMS OF CUT SHEETS

[76] Inventor: Leroy J. Thompson, 2716 W. Lawrence La., Phoenix, Ariz. 85051

[21] Appl. No.: 08/711,121

[22] Filed: Sep. 9, 1996

[51] Int. Cl.[6] ..... B26D 5/00

[52] U.S. Cl. ..... 83/404.1; 83/155; 83/371

[58] Field of Search ..... 83/404.1, 107, 83/371, 155, 86, 90

[56] References Cited

U.S. PATENT DOCUMENTS

| | | | |
|---|---|---|---|
| 3,224,306 | 12/1965 | Hawley et al. . | |
| 3,555,948 | 1/1971 | Olson | 83/346 |
| 4,203,334 | 5/1980 | Zettler | 83/86 |
| 4,405,121 | 9/1983 | Hill . | |
| 4,463,677 | 8/1984 | Kuehfuss | 83/371 |
| 4,538,517 | 9/1985 | Michalik . | |
| 4,641,555 | 2/1987 | Johnson et al. | 83/88 |
| 4,932,932 | 6/1990 | Schmidt et al. | 83/343 |
| 5,397,106 | 3/1995 | Hill | 83/408 |

*Primary Examiner*—M. Rachuba
*Attorney, Agent, or Firm*—Tod R. Nissle, P.C.

[57] ABSTRACT

Collating apparatus cuts a strip of paper into two side-by-side streams of individual pages or sheets of paper. These streams of paper are transported on belts such that each sheet in one stream is next to and paired with a sheet in the other stream. Each pair of sheets is stacked by moving one of the sheets onto the other which the other sheets continues to be transported by belt. Each stacked pair of sheets can be stacked on each other.

13 Claims, 6 Drawing Sheets

FIG. 4
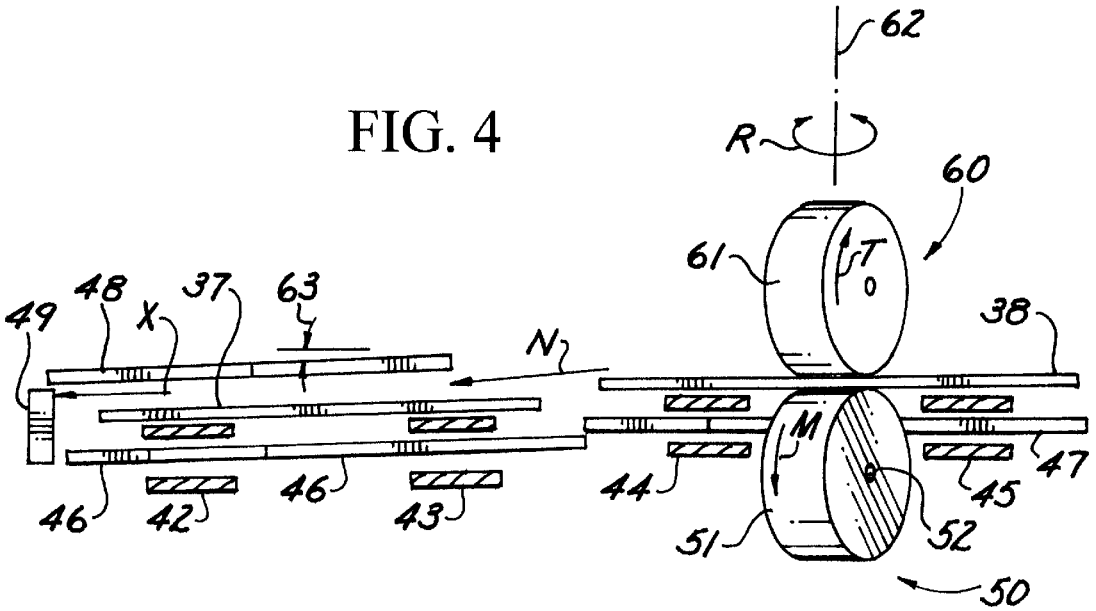
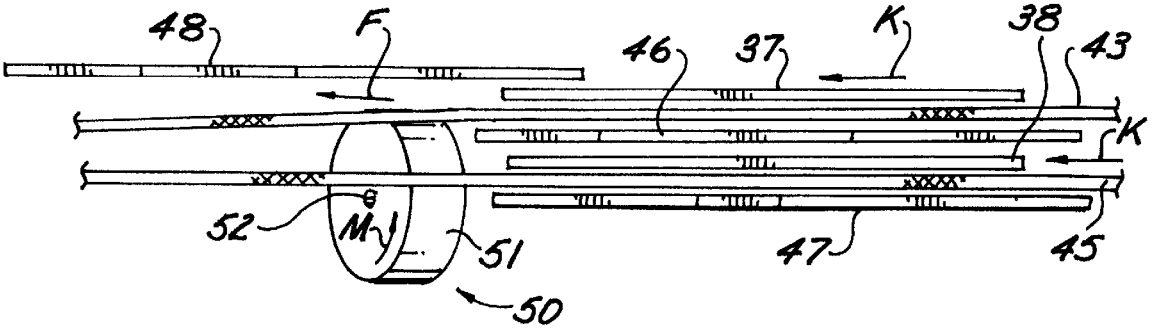
FIG. 5

SYSTEM AND METHOD FOR COLLATING AND STACKING TWO STREAMS OF CUT SHEETS

BACKGROUND OF THE INVENTION

This invention relates to a method and apparatus for processing paper.

More particularly, the invention relates to a method and apparatus for processing a strip of paper into two streams of cut sheets and for collating the streams.

In a further respect, the invention pertains to a method and apparatus which facilitates the collating of two streams of separate sheets of paper by laterally displacing sheets in one stream into registration with sheets in the other stream while maintaining a constant speed of movement of both streams in a selected direction of travel.

In another respect, the invention pertains to a method and apparatus which facilitates the collating of two streams by producing sheets of differing length in either or both streams.

A prior art method for processing a strip of paper 10 to cut and collate pages formed on the strip of paper is illustrated in FIG. 1. In FIG. 1, paper strip 10 has a width indicated by arrows W and includes longitudinal centerline 21 and laterally extending lines of weakening 11 formed at equal intervals therealong. The lines of weakening 11 can comprise imperforate lines, can comprise line formed by die cutting part way through strip 10, can comprise imprinted lines, can comprise imaginary lateral lines which pass through a timing mark or some other mark on strip 10, or can simply comprise locations which can be identified by equipment which processes strip 10. Information, for example alphanumeric characters 22 and 23, is formed on strip 10. The information is formed by printing or any other desired means and typically comprises alphanumeric characters, illustrations, or any other desired data or forms. The information is formed on strip 10 in locations which anticipate that strip 10 will be cut into equal sized separate sheets or pages which comprise multiple documents or "jobs" and that the separate sheets or pages will be collated and stacked. As used herein, the term paper is understood to include thin sheets of material upon which alphanumeric characters, illustrations, etc. can be formed. While such material normally comprises a cellulose composition, plastics, fabrics or other materials can be utilized.

At point A in FIG. 1, a cutting apparatus slits strip 10 along its longitudinal centerline 21 to form a pair of supplemental paper strips 13 and 14.

At point B in FIG. 1, collating of supplemental paper strips 13 and 14 begins.

At point C in FIG. 1, supplemental paper strips are fully collated into registration with one another.

At point D in FIG. 1, collated supplemental paper strips are cut along lines of weakening 11 to form discrete stacks of paper each comprised of a pair of pages or sheets.

At point E in FIG. 1, a stacked pair of pages 15 and 16 is illustrated. Each sequential stacked pair of pages ordinarily is stacked on top of the preceding previously stacked pairs of pages which comprise a document. Once all of the pages in a document are stacked, or separated from other cut pairs of sheet produced by the method of FIG. 1, then a new stack of separated page pairs is begun which comprises another document. Such stacking and separating of documents can be done manually or with equipment.

The prior art process illustrated in FIG. 1 has disadvantages. First, the process of FIG. 1 stacks and separate pairs

15, 16 of sheets or pages. If a document includes an odd number of pages, then a blank or "waste" page ordinarily is formed on strip 10 adjacent the last page of the document. Second, the process of FIG. 1 has no provision for separating out prior to collating and stacking a single page from the processing stream. Third, if one large stack of sheets including multiple documents is formed using the process of FIG. 1, there is no easy way to determine quickly the location of each document in the stack.

Accordingly, it would be highly desirable to provide an improved method and apparatus which would cut and collate pages in a strip of paper such that waste blank pages would not have to be included on a strip of paper being cut and collated, such that designated sheets could be removed from a stream of cut sheets, and such that the location of documents in the stack could be readily determined.

Therefore, it is a principal object of the invention to provide an improved method and apparatus for separating a strip of paper containing multiple documents into cut sheets and for collating the cut sheets.

A further object of the invention is to provide an improved method and apparatus for processing a paper strip into a stack of paper sheets comprising multiple documents such that the location of each document in the stack can be readily identified.

Another object of the invention is to provide an improved method and apparatus for processing a paper strip which facilitates the location of each sheet imprinted on the paper strip so that selected sheets can be cut from the strip having lengths different from other sheets in the strip.

Yet another object of the invention is to provide an improved method and apparatus for processing a paper strip into a stream of sheets which enables selected pages to be removed from the stream of sheets before the sheets are collated and stacked.

These and other, further and more specific objects and advantages of the invention will be apparent to those skilled in the art from the following detailed description thereof, taken in conjunction with the drawings, in which:

BRIEF DESCRIPTION OF THE DRAWINGS

FIG. 4 is a section view of a portion of the apparatus of FIG. 3 taken along section line 4—4 thereof and illustrating additional construction details thereof;

FIG. 5 is a side view of a portion of the apparatus of FIG. 3;

SUMMARY OF THE INVENTION

Figure 1:
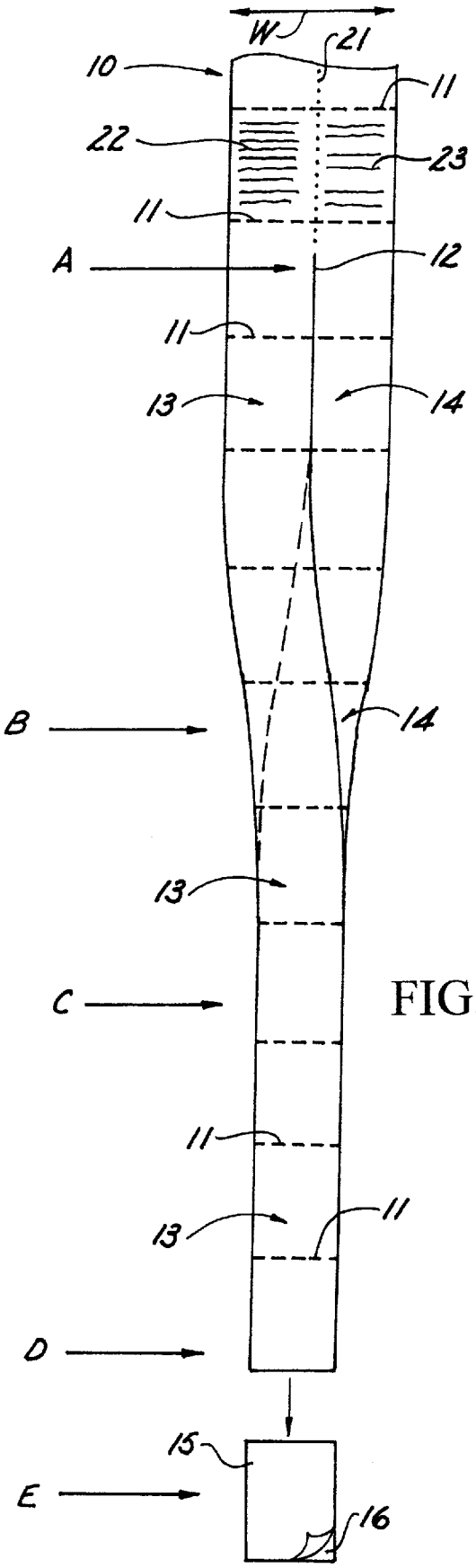
FIG. 1 (PRIOR ART)
FIG. 1 is a flow chart illustrated a prior art process for processing a strip of paper into a plurality of stacked sheets each having an equivalent shape and dimension.

Briefly, in accordance with my invention, I provide an improved system for processing a strip of paper. The system includes a cutter assembly for longitudinally and laterally cutting the strip of paper to form first and second streams each comprised of sheets of paper; and, collating apparatus for merging sheets in the first stream with sheets in the second stream. The collating apparatus includes belts for moving the first stream in a selected direction of travel at a selected speed; belts for moving the second stream in the selected direction of travel at the selected speed; and, displacement apparatus for laterally displacing each sheet in the second stream laterally to a position in registration with a sheet in the first stream. The displacement apparatus continues to move each sheet in the second stream in the selected direction of travel at the selected speed while moving the sheets in the second streams laterally to a position in registration with sheets in the first stream.

In another embodiment of my invention, I provide an improved method for processing a strip of paper. The strip of paper includes a longitudinal center line; laterally extending lines of weakening formed at equal intervals therealong; multiple pages formed thereon; and, a plurality of documents each consisting of a selected number of the pages. The improve method includes the steps of determining the location of at least one of the documents in the strip of paper; cutting said strip of paper along said longitudinal centerline and on said lines of weakening to form first and second streams each comprised of cut sheets of paper. Each of the cut sheets comprising one of the pages. The sheets of paper comprise a plurality of documents each including at least one of the sheets. The length of one of the sheets comprising one of the documents is different with respect to at least one other sheets in the first and second streams to facilitate locating the document when the cut sheets of paper are stacked. The sheets in the first stream are merged with sheets in the second stream by moving sheets in the first stream in a selected direction of travel at a selected speed; by moving sheets in the second stream in the selected direction of travel at the selected speed; and, by laterally displacing each sheet in the second stream to a position in registration with a sheet in the first stream.

In a further embodiment of my invention, I provide an improved system for processing a strip of paper having a longitudinal center line and having laterally extending lines of weakening formed at equal intervals therealong. The system includes severing apparatus for cutting the strip of paper along the longitudinal centerline and on the lines of weakening to form first and second streams each comprised of cut sheets of paper. The cut sheets of paper comprise a plurality of documents each including at least one of the sheets. The severing apparatus includes a sensor for determining the location of at least one selected document in said strip of paper; apparatus means for altering the length of one of the sheets comprising the selected document with respect to at least one other of the cut sheets of paper to facilitate locating the selected document when the cut sheets of paper are stacked; and, collating apparatus for merging sheets in the first stream with sheets in the second stream. The collating apparatus includes belts for moving the first stream in a selected direction of travel at a selected speed; belts for moving the second stream in the selected direction of travel at the selected speed; displacement apparatus for laterally displacing each sheet in the second stream laterally to a position in registration with a sheet in the first stream.

DETAILED DESCRIPTION OF THE EMBODIMENTS

Figure 2A:
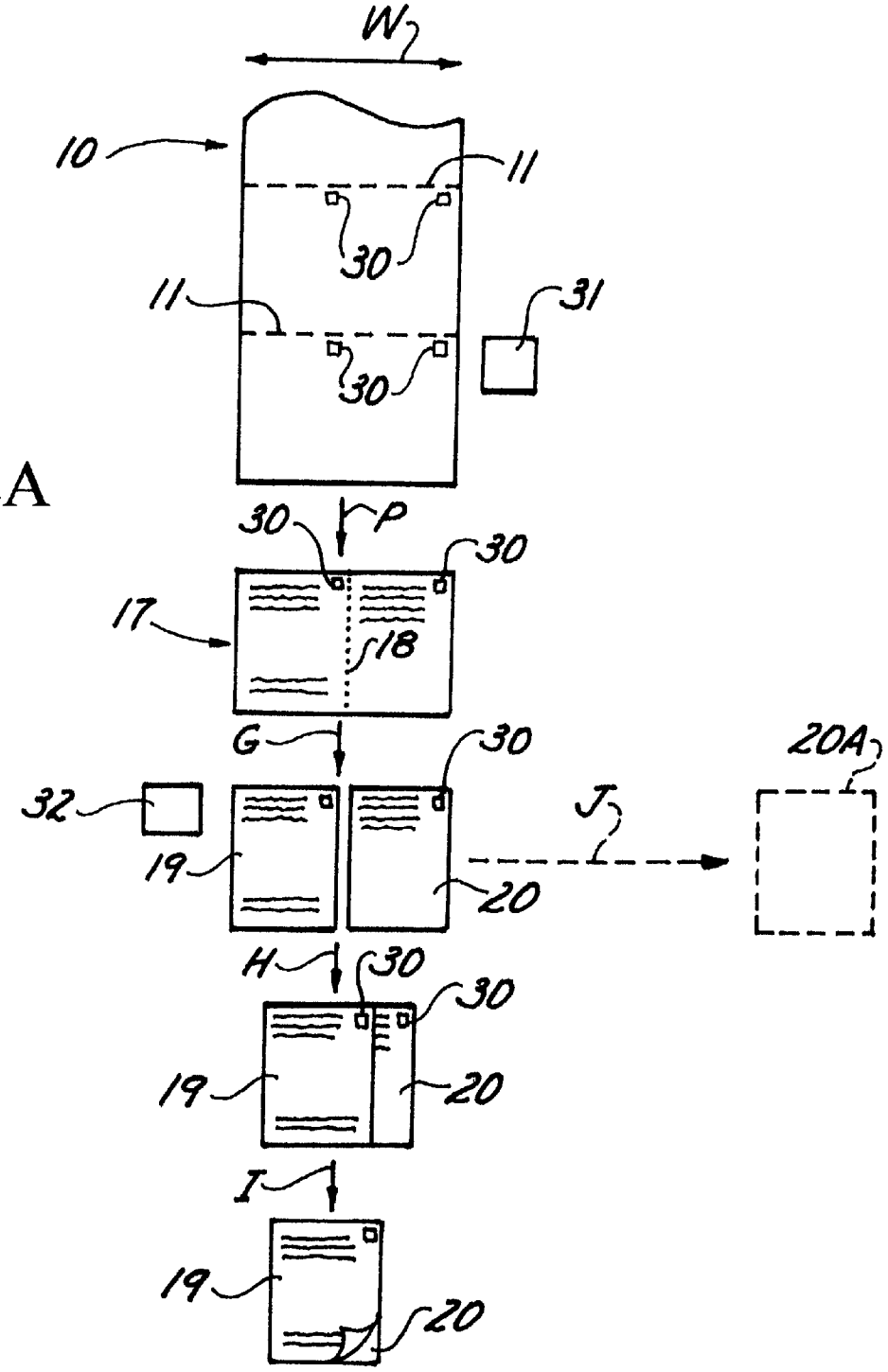
FIGS. 2A and 2B are flow charts illustrating the processing of a strip of paper in accordance with the principles of the invention.

Turning now to the drawings which depict the presently preferred embodiments of the invention for the purpose of describing the operation thereof and not by way of limitation of the scope of the invention, and in which like reference characters refer to corresponding elements throughout the several views, FIG. 2A illustrates one embodiment of the invention for processing a strip of paper 10 having laterally extending lines of weakening 11 formed at equal intervals therealong. A pair of marks 30 are formed adjacent each line of weakening 11. The marks 30 can function as timing marks, can be detected by a sensor 31 which is utilized to monitor the location in on processing equipment of each sheet or page 19, 20 in strip 10, or can perform any other desired function. Marks 30 could, for example, provide information in the form of a bar code. Strip 10 passes into on apparatus which cuts or separates strip 10 along each line of weakening 11 and displaces the resulting sheet 17 in the direction of arrow P. Sheet 17 then passes into apparatus which cuts sheet 17 along its centerline 18 to form a pair of sheets or pages 19 and 20 which are displaced in the direction of arrow G. Sensor 32, either alone or in conjunction with other sensors 31, determines that sheets 19 and 20 are adjacent sensor 32 and provides this information to a microprocessor or other apparatus which is controlling the operation of the equipment processing strip 10. The microprocessor may determine that sheet 20 should be removed from the paper processing stream, in which case the microprocessor directs apparatus to displace sheet 20 in the direction of arrow J to a desired location indicated by dashed lines 20A. Otherwise sheets 19 and 20 are displaced in the direction of arrow H and are collated such that sheet 19 is stacked on top of and in registration with sheet 20. Each collated stack comprising a pair of sheets 19 and 20 can be stacked on top of and in registration with the other to form a stack which typically can be hundreds of sheets high.

Figure 2B:
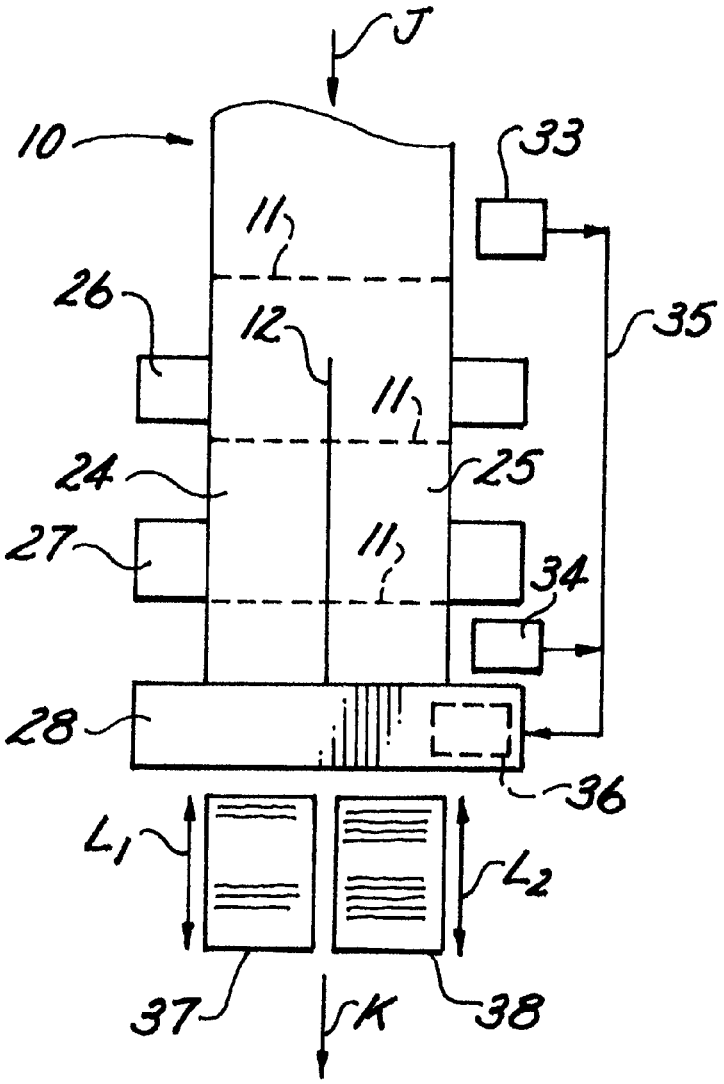

FIG. 2B illustrates another embodiment of the invention for processing a strip of paper 10 having laterally extending lines of weakening 11 formed at equal intervals therealong. Sensors 33 and 34 monitor marks on strip 10, monitor the speed of travel of strip 10, monitor openings along the edge of strip 10, or monitor any other desired movement or information pertaining to the processing of strip 10 such that the location of each page or sheet which is on strip 10 and is to be cut from strip 10 is known with respect to the equipment processing strip 10. Equipment for monitoring the location of a point, or points, or of pages or sheets integrally formed in strip 10 is well known in the art and will not be discussed in detail herein. But for purposes of FIG. 2B, it is assumed that sensors 33 and/or 34 monitor the progress of strip 10 through the slitter 26, loop box 27, and cutter 28 such that the location of each line of weakening 11 or page with respect to cutter 28 is known.

In FIG. 2B, strip 10 passes into slitter 26 which cuts or separates 12 strip 10 along it longitudinal centerline to form a pair 24, 25 of paper strips. Each paper strip 24, 25 travels into a loop box 27. In box 27 each strip 24, 25 forms a two or three foot deep loop which hangs toward the floor under gravity. Box 27 functions to eliminate tension in strips 24, 25 and give them freer play so that a page 38 in one strip 25 can, as will be described below, be incremented through cutter 28 slightly faster (or slower) than its laterally adjacent page 37 in strip 24 so that page 38 can be cut slightly longer (or shorter). Cutting page 38 longer is desirable when page 38 is the beginning or last page in a document. When page 38 is slightly longer then, after all of the page pairs which are cut from strip 10 are placed in registration one on top of the other to form a stack of pages or sheets, the location in the stack of the document including page or sheet 38 is readily visually determined because page 38 is longer than adjacent sheets and extends a short distance out from one side of the stack of sheets.

Figure 7:
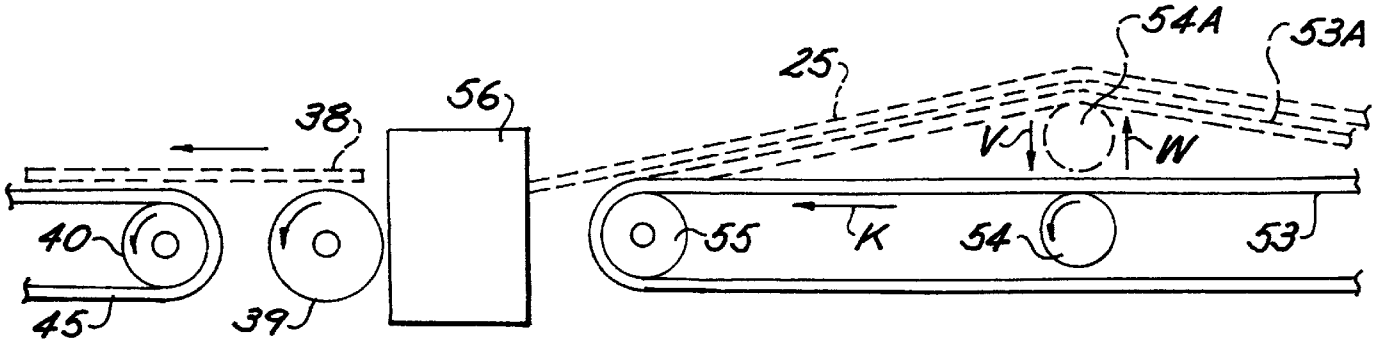

Sensors 33 and 34 in FIG. 2B provide 35 information to microprocessor 36. The information provided by sensors 33 and 34 enables microprocessor 36 to determine when a line of weakening 11 and each particular page 37, 38 on a strip 24, 25 are passing through cutter 28. Sensors 33 and 34 or other data input means also indicates to microprocessor 36 when a page 37, 38 comprises the first, last, or only page in one of the documents imprinted or formed on strip 10. By way of example, and not limitation, if a sheet 38 on strip 25 comprises the last sheet in a document, then microprocessor 36 can cause a roller 54 (FIG. 7) which has a normal operating position indicated by dashed lines 54A to be momentarily slightly displaced downwardly a short distance in the direction of arrow V to the position shown by solid circular line 54 and to then upwardly displace in the direction of arrow W the roller back up to the position indicated by dashed lines 54A. Momentarily downwardly displacing roller 54 flattens out a conveyor belt 53A, shorten the distance which a sheet 38 in strip 10 has to travel, and functions to permit the sheet 38 to more quickly pass into and through cutter blade assembly 56. When sheet 38 passes through blade assembly 56 more quickly than normal (and sheet 37 does not), then, when blade assembly 56 is provided with a setting which causes blade assembly 56 to cut strip along lines of weakening 11 at equivalent time intervals when strip 10 is traveling through assembly 56 at a selected speed, assembly 56 won't cut strip 10 along a line of weakening 11, but will instead "miss" the line of weakening and will cut sheet 38 along a line which succeeds and is past the line of weakening and which is parallel to and spaced apart from the line of weakening 11. As a result, the length L2 of sheet 38 will be slightly greater than the length L1 of sheet 37. In the example in this paragraph, it is assumed that strip 24 is being carried by a conveyor—roller assembly identical to the conveyor 53A—roller 54 assembly shown in FIG. 7, but that when roller 54A is downwardly displaced in the direction of arrow V, the comparable roller serving the conveyor carrying strip 24 is no so displaced. Consequently, the speed of travel of strip 24 remains the same while the speed of travel of strip 25 is momentarily increased. As a result, the length of page or sheet 37 is less than the length of sheet 38. The leading edges of sheets 37 and 38 are cut when sheets 37 and 38 are side-by-side. In contrast, the trailing edges of sheets are cut when sheet 38 has been incrementally advance a short distance ahead of sheet 37 by momentarily lowering roller 54A a short distance. In FIG. 7 endless conveyor belt 53 is driven in the direction of arrow K by roller 55 and by another roller (not visible in FIG. 7).

The distance roller 54A is displaced in the direction of arrow V in FIG. 7 is exaggerated for the sake of clarity. Under actual operating conditions, roller 54A likely would have to be downwardly displaced in the direction of arrow V and then back up in the direction of arrow W only a relatively short distance. Instead of displacing roller 54A in the manner described above to alter then normal length of a sheet 38, microprocessor can, if desired, simply directly operate assembly 56 at varied time intervals to vary the length of sheets 37 and 38 cut from strip 10 by blade assembly 56 of cutter 28.

The apparatus for collating a laterally adjacent pair of sheets 37, 38 (or 19, 20) produced by cutter 28 is illustrated in FIGS. 3 to 6. A roller 39 directs a laterally adjacent pair of sheets 37, 38 or equal or similar size in the direction of arrow K onto endless conveyor belts 42 to 45. Belts 42 to 45 carry sheets 37, 38 in the direction of arrow K. Belts 42 and 43 pass over fixed plate 46 and beneath fixed plate 48. Belts 44 and 45 pass over fixed plate 47. Plates 48 and 46 are presently parallel and are each canted at an angle 63 (FIG. 4) from the horizontal which is in the range of one degree to twenty degrees, preferably five to fifteen degrees. In the presently preferred embodiment of the apparatus of FIG. 4, angle 63 is ten degrees. The elevation of plate 47 is greater than that of plate 46 to facilitate the overlaying of sheet 38 on its laterally adjacent sister sheet 37 when sheet 38 is laterally displaced in the direction of arrows N and X. Sheet 38 typically contacts stop member 49 in the direction of arrow X and rebounds away from member 49 to a position in which sheet 38 is approximately in registration with sheet 37. Plate 48 functions to prevent sheets 37 and 38 from curling and prevents sheet 38 from traveling up and over stop member 49. The direction indicated by arrow X typically is equivalent to that indicated by arrow N.

Figure 6:
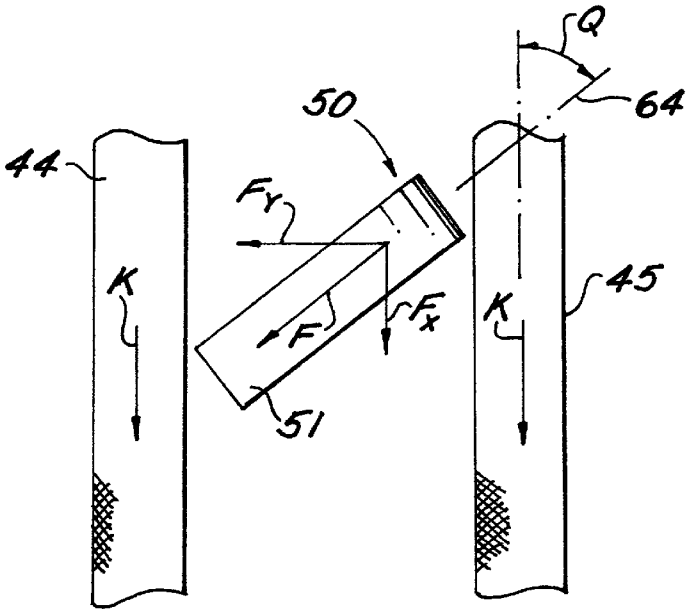
FIG. 6 is a top view of the displacement wheel of the apparatus of FIG. 3 further illustrating the mode of operation thereof; and, FIG. 7 is a side view of the paper cutting unit of FIG. 2B illustrating further construction details thereof.

The lateral displacement of sheet 38 in the direction of arrow N is accomplished by displacement wheel 50 which rotates in the direction of arrow M about a fixed axle (not shown) which passes through circular opening 52 of wheel 50. The peripheral cylindrical surface 51 of wheel 50 contacts sheet 38 when sheet 38 passes over wheel 50. Wheel 50 generates a force on sheet 38 which acts in the direction indicated by arrow F in FIGS. 3, 5, and 6. As shown in FIG. 6, force F includes a lateral component $F_Y$ and a forward component $F_X$. Component $F_Y$ functions to laterally displace sheet 38 in toward stop member 49 and sheet 37. Component $F_X$ has a magnitude comparable to and preferably equivalent to the speed at which belts 44 and 45 move sheet in the direction of arrow K.

The longitudinal axis of wheel 50 lies intermediate the opposing, spaced apart circular faces of wheel 50 and is coincident with line 64 in FIG. 6. The angle Q between axis 64 and the direction of travel K of belts 44 and 45 is must be within plus or minus ten degrees of the preferred angle. The presently preferred angle is about sixty degrees, although any desired angle can be utilized. Consequently, the presently preferred value of angle Q is in the range of fifty to seventy degrees.

A sheet 38 of paper traveling over wheel 50 also contacts wheel 61. Wheel 61 free wheels and is free to rotate about a vertical axis 62 in the direction of arrows R. The ability of wheel to rotate in the direction of arrows R permits wheel 61 to readily align itself with the direction M in which wheel 50 is rotating. Wheel 61 can be driven if desired.

Figure 3:
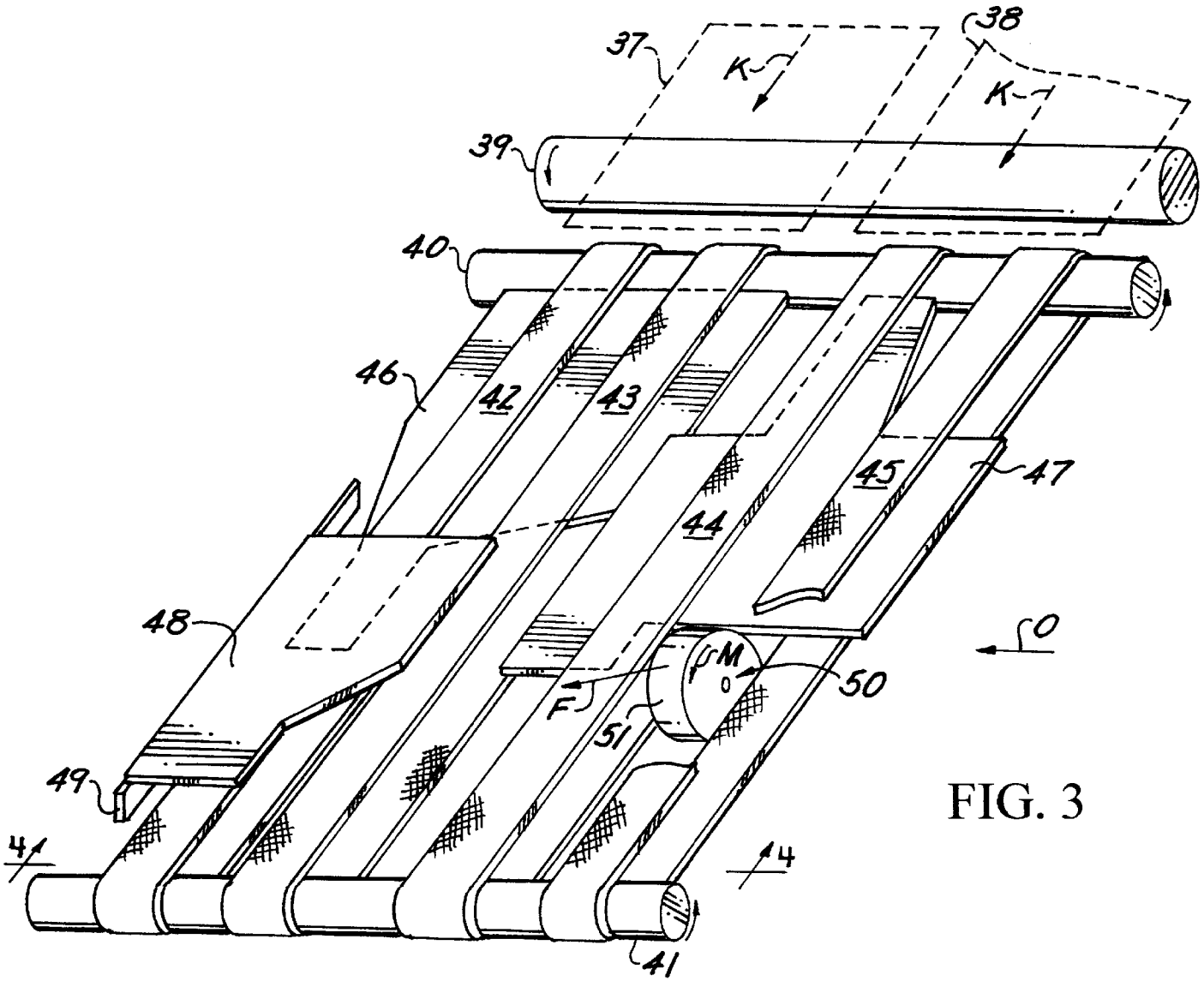
FIG. 3 illustrates sheet collating apparatus constructed in accordance with the invention.

FIG. 5 further illustrates the interrelationship between plates 46 to 48, wheel 50, belts 43 and 45, and sheets 37 and 38 being collated by the apparatus of FIG. 3. FIG. 5 depicts plates 46 to 48, wheel 50, and belts 43 and 45 when viewed from the side as indicated by arrow O in FIG. 3.

Having described my invention in such terms as to enable those skilled in the art to make and practice the invention, I claim:

1. A system for collating and stacking two streams of sheets cut from a moving strip of paper having a longitudinal centerline and a pair of spaced apart outer edges parallel to the centerline, said system comprising:

(a) cutting means for cutting said strip of paper (i) laterally from one side of the strip to the other side of the strip, and, (ii) longitudinally along a line parallel to the centerline of the strip to form a first stream and a second stream each comprised of a plurality of separate sheets of paper; and, (b) collating means for merging sheets in said first stream with sheets in said second stream, said collating means including (i) first belt means for moving said first stream in a selected direction of travel at a selected speed, (ii) second belt means for moving said second stream adjacent and generally parallel said first stream in said selected direction of travel at said selected speed such that each of said cut sheets in said second stream is side-by-side with an associated one of said cut sheets in said first stream, (iii) displacement means for, while said first belt means and said second belt means continue to move said first stream in said selected direction of travel, laterally displacing each of said cut sheets in said second stream laterally off said second belt means to a position in registration with the said one of said cut sheets in said first column side-by-side with said cut sheet in said second stream, said displacement means continuing to move each of said cut sheets in said second stream in said selected direction of travel at said selected speed while moving each of said cut sheets in said second stream laterally to a position in registration with one of said cut sheets in said first stream.

2. A method for collating and stacking two streams of sheets cut from a moving strip of paper having a longitudinal centerline and having laterally extending lines of weakening formed at equal intervals along the strip, multiple pages formed on the strip, a plurality of documents each consisting of a selected number of said pages, said method comprising:

(a) selecting at least one reference page in at least one of said documents and determining the location of said selected reference page in said strip of paper;

(b) cutting said moving strip of paper along said longitudinal centerline and on said lines of weakening (i) to form a first and a second stream each comprised of cut sheets of paper, each of said cut sheets comprising one of said pages and having a length, (ii) such that said cut sheets of paper comprise a plurality of documents each including at least one of said sheets, one of said cut sheets comprising said reference page, and (iii) such that the length of said one of said cut sheets is different with respect to at least one other of said cut sheet in said first and second streams to facilitate locating said selected document when said cut sheets of paper are stacked; and, (c) merging said cut sheets in said first stream with said cut sheets in said second stream by (i) moving said cut sheets in said first stream in a selected direction of travel at a selected speed, (ii) moving said cut sheets in said second stream in said selected direction of travel at said selected speed, and (iii) laterally displacing each of said cut sheets in said second stream to a position in registration with one of said cut sheets in said first stream.

3. A system for processing a strip of paper having a longitudinal center line and having laterally extending lines of weakening formed at equal intervals therealong, comprising:

(a) severing means for cutting said strip of paper along said longitudinal centerline and on said lines of weakening to form first and second streams each comprised of cut sheets of paper, said cut sheets of paper comprising a plurality of documents each including at least one of said sheets, said severing means including (i) sensor means for determining the location of at least one selected document in said strip of paper, and (ii) means for altering the length of one of the sheets comprising said selected document with respect to at least one other of said cut sheets of paper to facilitate locating said selected document when said cut sheets of paper are stacked; and, (b) collating means for merging sheets in said first stream with sheets in said second stream, said collating means including (i) belt means for moving said first stream in a selected direction of travel at a selected speed, (ii) belt means for moving said second stream in said selected direction of travel at said selected speed, (iii) displacement means for laterally displacing each sheet in said second stream laterally to a position in registration with a sheet in said first stream.

4. The system of claim 1 wherein said collating means includes means for removing one of said cut sheets (20A) carried by said second belt means before said one of said cut sheets removed from said second belt means is collated with one of said cut sheets in said first stream.

5. The method of claim 2 including the additional step intermediate steps (b) and (c) of removing at least one of said cut sheets (20A) from said at least one of said first and second streams.

6. The method of claim 2 wherein:

(a) said strip of paper includes at least first and second portions (24,25);

(b) said first and second portions each move at a determined speed of travel;

(c) said one of said cut sheets is cut from said second portion; and, (d) in step (iii)(b) the length of said one of said cut sheets is made different with respect to said one other of said cut sheets by altering said determined speed of travel of said second portion with respect to said first portion prior to cutting said one of said cut sheets from said second portion.

7. The system of claim 1 wherein said displacement means includes a stop (49) which each sheet in said second stream strikes and rebounds from when said displacement means laterally displaces each sheet in said second stream to a position in registration with a sheet in said first stream.

8. The system of claim 1 wherein (a) said strip of paper includes at least a first portion (24) and a second portion (25); and, (b) said cutting means includes means (54) for altering the speed of travel of said first portion with respect to said second portion.

9. The system of claim 1 wherein said displacement means includes a rotating wheel (50) which generates a lateral displacement force (F) on each of said cut sheets in said second stream which contact said wheel (50), said force (F) being at an angle (Q) in the range of fifty to seventy degrees with respect to said selected direction of travel.

10. The system of claim 9 wherein said displacement means includes a stop which each sheet in said second stream strikes when laterally displaced by said rotating wheel (50).

11. The system of claim 1 wherein said cutting means includes means (54) for altering the distance traveled by paper entering said cutting means.

12. The system of claim 1 wherein said cutting means includes means (54) for displacing at least one of said first and second belt means to alter the length of one of said cut sheets produced when paper in said strip of paper is cut by said cutting means.

13. The system of claim 1 wherein said collating means includes means for removing one of said cut sheets (20A) carried by said first belt means before said one of said cut sheets removed from said first belt means is collated with one of said cut sheets in said second stream.

* * * * *